US008854402B2

(12) United States Patent
Li et al.

(10) Patent No.: US 8,854,402 B2
(45) **Date of Patent: *Oct. 7, 2014**

(54) LIQUID CRYSTAL DISPLAY APPARATUS AND DRIVING METHOD THEREOF

(75) Inventors: Yu Li, Suwon-si (KR); Sang-kyun Im, Seoul (KR); Nam-kyun Beon, Seoul (KR); Ji-yong Park, Suwon-si (KR); Young-hoon Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 975 days.

This patent is subject to a terminal disclaimer.

(21) Appl. No.: 12/868,008

(22) Filed: Aug. 25, 2010

(65) Prior Publication Data

US 2011/0050753 A1 Mar. 3, 2011

(30) Foreign Application Priority Data

Aug. 25, 2009 (KR) ..... 10-2009-0078704

(51) Int. Cl.

| | |
|---|---|
| ***G09G 5/10*** | (2006.01) |
| ***G09G 5/02*** | (2006.01) |
| ***G09G 3/20*** | (2006.01) |
| *G09G 3/36* | (2006.01) |

(52) U.S. Cl.

CPC ..... *G09G 3/3614* (2013.01); *G09G 3/2077* (2013.01); *G09G 2340/0457* (2013.01); *G09G 3/36* (2013.01); *G09G 3/2074* (2013.01); *G09G 2320/0257* (2013.01); *G09G 2320/0204* (2013.01)

USPC ..... 345/696; 345/690; 345/694

(58) Field of Classification Search

CPC ..... G09G 3/36; G09G 3/2074; G09G 3/2077; G09G 3/3611; G09G 3/3614; G09G 3/3648; G09G 2340/0457

USPC ..... 345/30–104, 690–699, 204–215, 530, 345/596; 349/37, 144, 151

See application file for complete search history.

(56) References Cited

U.S. PATENT DOCUMENTS

| | | | | |
|---|---|---|---|---|
| 7,495,645 | B2 * | 2/2009 | Jang | 345/92 |
| 7,733,335 | B2 * | 6/2010 | Zehner et al. | 345/204 |
| 8,416,256 | B2 * | 4/2013 | Neal et al. | 345/596 |
| 8,451,205 | B2 * | 5/2013 | Kitayama et al. | 345/94 |
| 2003/0169247 | A1 * | 9/2003 | Kawabe et al. | 345/204 |

(Continued)

FOREIGN PATENT DOCUMENTS

| | | | |
|---|---|---|---|
| EP | 2276017 | A1 | 1/2011 |
| JP | 200510579 | A | 1/2005 |

OTHER PUBLICATIONS

Communication dated Aug. 3, 2012 from the European Patent Office in counterpart European application No. 10157764.1.

(Continued)

*Primary Examiner* — Dwayne Bost
*Assistant Examiner* — Darlene M Ritchie
(74) *Attorney, Agent, or Firm* — Sughrue Mion, PLLC

(57) ABSTRACT

A liquid crystal display (LCD) apparatus and a method of driving the LCD apparatus are provided. The LCD apparatus includes a panel unit including at least one pixel having a plurality of sub-pixels and a controller which inserts gray data into at least one pixel of the plurality of sub-pixels based on a frame period and a polarity of a liquid crystal of the at least one pixel.

26 Claims, 10 Drawing Sheets

(56) References Cited

U.S. PATENT DOCUMENTS

| | | | | |
|---|---|---|---|---|
| 2006/0012593 | A1* | 1/2006 | Iriguchi et al. | 345/204 |
| 2006/0164361 | A1 | 7/2006 | Yi | |
| 2007/0188506 | A1* | 8/2007 | Hollevoet et al. | 345/530 |
| 2007/0291190 | A1* | 12/2007 | Shin et al. | 349/37 |
| 2008/0001902 | A1* | 1/2008 | Kim | 345/100 |
| 2008/0074601 | A1* | 3/2008 | Lee et al. | 349/144 |
| 2008/0079852 | A1 | 4/2008 | Nagaishi et al. | |
| 2008/0179677 | A1 | 7/2008 | Murata et al. | |
| 2008/0180369 | A1 | 7/2008 | Chiu et al. | |
| 2008/0180378 | A1* | 7/2008 | Tang | 345/96 |
| 2008/0204444 | A1 | 8/2008 | Ryu et al. | |
| 2008/0238897 | A1 | 10/2008 | Kimura | |
| 2008/0266225 | A1* | 10/2008 | Kim | 345/88 |
| 2008/0297457 | A1 | 12/2008 | Song et al. | |
| 2009/0040243 | A1* | 2/2009 | Hisada et al. | 345/690 |
| 2009/0058782 | A1* | 3/2009 | Watanabe et al. | 345/94 |
| 2009/0109209 | A1* | 4/2009 | Hidaka et al. | 345/214 |
| 2009/0122088 | A1* | 5/2009 | Kim | 345/690 |
| 2009/0289883 | A1* | 11/2009 | Choi | 345/89 |
| 2010/0002021 | A1* | 1/2010 | Hashimoto et al. | 345/690 |
| 2010/0134533 | A1* | 6/2010 | Moon et al. | 345/690 |
| 2010/0220123 | A1* | 9/2010 | Yamazaki et al. | 345/691 |

OTHER PUBLICATIONS

Communication dated Jul. 4, 2011 from the European Patent Office in counterpart European Patent Application No. 10157764.1.

Extended European Search Report issued Jul. 5, 2010 in counterpart European Patent Application No. 10158531.3.

U.S. Non-Final Office Action issued in U.S. Appl. No. 12/728,625 dated Oct. 2, 2012.

* cited by examiner

LIQUID CRYSTAL DISPLAY APPARATUS AND DRIVING METHOD THEREOF

CROSS-REFERENCE TO RELATED APPLICATIONS

This application claims priority from Korean Patent Application No. 10-2009-0078704, filed on Aug. 25, 2009, in the Korean Intellectual Property Office, the disclosure of which is incorporated herein by reference in its entirety.

BACKGROUND

1. Field

Apparatuses and methods consistent with exemplary embodiments relate to a liquid crystal display (LCD) apparatus and a method of driving the LCD apparatus, and more particularly, to an LCD apparatus which prevents a residual image from appearing on a screen, and a method for driving the LCD apparatus.

2. Description of the Related Art

Televisions (TVs) continue to become larger, and thus, users may view video through relatively large screens. This increase in size of TVs has been greatly accelerated as a result of the development of thin film transistor liquid crystal displays (TFT-LCDs) and plasma display panels (PDPs) which are representative of flat display apparatuses.

Such large-sized TVs are used for advertisement and information transfer services to provide a variety of content and dynamic moving images, so as to more effectively appeal to users, compared to general advertisement services for providing flat and fragmentary content. Display apparatuses for providing a variety of dynamic content are referred to as digital information displays (DIDs).

However, DIDs used for advertisement and information transfer services continue to be driven for a long period of time and display the same image on screens of DIDs for a long period of time, differently from display apparatuses useful for general broadcasting services. Accordingly, an image sticking problem may occur so that stress may be applied to liquid crystals and it may be difficult to switch between images, which may result in residual images appearing on DID screens.

Therefore, there is a need for methods to reduce the stress on liquid crystals in order to prevent residual images from appearing on DID screens thereby reducing inconvenience to a user viewing the DID screen.

SUMMARY OF THE INVENTION

Exemplary embodiments may overcome the above disadvantages and other disadvantages not described above. Also, the exemplary embodiments are not required to overcome the disadvantages described above, and an exemplary embodiment may not overcome any of the problems described above.

Exemplary embodiments provide an LCD apparatus for effectively eliminating a residual image phenomenon, and a method for driving the LCD apparatus.

According to an aspect of an exemplary embodiment, there is provided an LCD apparatus including a panel unit which includes at least one pixel including a plurality of sub-pixels, and a controller which inserts gray data into the plurality of sub-pixels taking into consideration a frame period and a polarity of a liquid crystal of the at least one pixel.

During at least one frame period, the controller may insert the gray data in such a manner that a sub-pixel, which is contained in a first pixel and into which the gray data is not inserted, and another sub-pixel, which is contained in a second pixel neighboring the first pixel and into which the gray data is not inserted, may form at least one pixel.

The controller may insert the gray data, in such a manner that a sub-pixel of at least one pixel into which the gray data is not inserted in a first frame, and a sub-pixel of at least one pixel into which the gray data is not inserted in a second frame subsequent to the first frame, may form at least one pixel.

The controller may insert the gray data according to a pattern in which the gray data is inserted at least once into a plurality of sub-pixels of each pixel during a preset frame period.

The pattern may include a plurality of sub-patterns. The controller may cause the plurality of sub-patterns to be changed in every preset frame period.

A changed sub-pattern may be partially identical to the order of the original sub-pattern. In the changed sub-pattern, the controller may insert the gray data first into a sub-pixel, into which gray data has been inserted secondarily in the original sub-pattern, and may insert the gray data lastly into a sub-pixel, into which gray data has been inserted first in the original sub-pattern.

The controller may determine a frame in which the gray data is to be inserted again, in such a manner that the number of times when liquid crystals of a pixel including a predetermined sub-pixel have a positive polarity equals the number of times when the liquid crystals have a negative polarity, between a frame in which the gray data is inserted into the predetermined sub-pixel, and the frame in which the gray data is to be inserted again.

A period between the frame into which the gray data is inserted and the frame into which the gray data is to be inserted again may be an odd-numbered frame period.

The LCD apparatus may further include an input unit which receives an input of red, green, blue (RGB) data. The controller may generate a gray data mask based on information regarding sub-pixels of a current frame into which the gray data needs to be inserted among the plurality of sub-pixels in the panel unit. The controller may mask the input RGB data with the gray data mask, and may insert the masked RGB data.

The LCD apparatus may further include a driving unit which generates a gray data voltage or a normal data voltage and applies the generated gray data voltage or normal data voltage to the plurality of sub-pixels. The controller may control the driving unit based on the masked RGB data to apply the gray data voltage or the normal data voltage to each of the plurality of sub-pixels, so that the gray data may be inserted.

According to an aspect of another exemplary embodiment, there is provided an LCD apparatus including a panel unit which includes at least one pixel, and a controller which inserts gray data for each sub-pixel contained in the at least one pixel.

According to an aspect of another exemplary embodiment, there is provided an LCD apparatus including a gate driver which transfers a gate-on voltage to at least one pixel including a plurality of sub-pixels, and a data driver which transfers a gray data voltage to the plurality of sub-pixels, taking into consideration a frame period and a polarity of a liquid crystal of the at least one pixel.

According to an aspect of another exemplary embodiment, there is provided a method of driving an LCD apparatus, the method including applying a gray data voltage to a part of a plurality of sub-pixels contained in at least one pixel and applying a normal data voltage to the other part, taking into consideration a frame period and a polarity of a liquid crystal of the at least one pixel; and displaying an image based on the gray data voltage and the normal data voltage.

The applying may include applying the normal data voltage during at least one frame period, in such a manner that a sub-pixel, which is contained in a first pixel and into which the gray data is not inserted, and another sub-pixel, which is contained in a second pixel neighboring the first pixel and into which the gray data is not inserted, form at least one pixel.

The applying may include applying the normal data voltage in such a manner that a sub-pixel of at least one pixel into which the gray data is not inserted in a first frame, and a sub-pixel of at least one pixel into which the gray data is not inserted in a second frame subsequent to the first frame, form at least one pixel.

The applying may include applying the gray data voltage according to a pattern in which the gray data is inserted at least once into a plurality of sub-pixels of each pixel during a preset frame period.

The pattern may include a plurality of sub-patterns. The applying may include applying the gray data voltage and the normal data voltage so that the plurality of sub-patterns are changed in every preset frame period.

A changed sub-pattern may be partially identical to the order of the original sub-pattern. The applying may include applying the gray data voltage in the changed sub-pattern, so that the gray data is inserted first into a sub-pixel, into which gray data has been inserted secondarily in the original sub-pattern, and the gray data is inserted lastly into a sub-pixel, into which gray data has been inserted first in the original sub-pattern.

The applying may include determining a frame in which the gray data is to be inserted again, in such a manner that the number of times when liquid crystals of a pixel including a predetermined sub-pixel have a positive polarity equals to the number of times when the liquid crystals have a negative polarity between a frame in which the gray data is inserted into the predetermined sub-pixel, and the frame in which the gray data is to be inserted again, and applying the gray data voltage to the determined frame.

A period between the frame into which the gray data is inserted and the frame into which the gray data is to be inserted again may be an odd-numbered frame period.

The method may further include receiving an input of RGB data, generating a gray data mask based on information regarding sub-pixels of a current frame into which the gray data needs to be inserted among a plurality of sub-pixels in a panel of the LCD apparatus, and masking the input RGB data with the gray data mask, wherein the applying includes applying the gray data voltage or the normal data voltage to the sub-pixels based on the masked RGB data.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
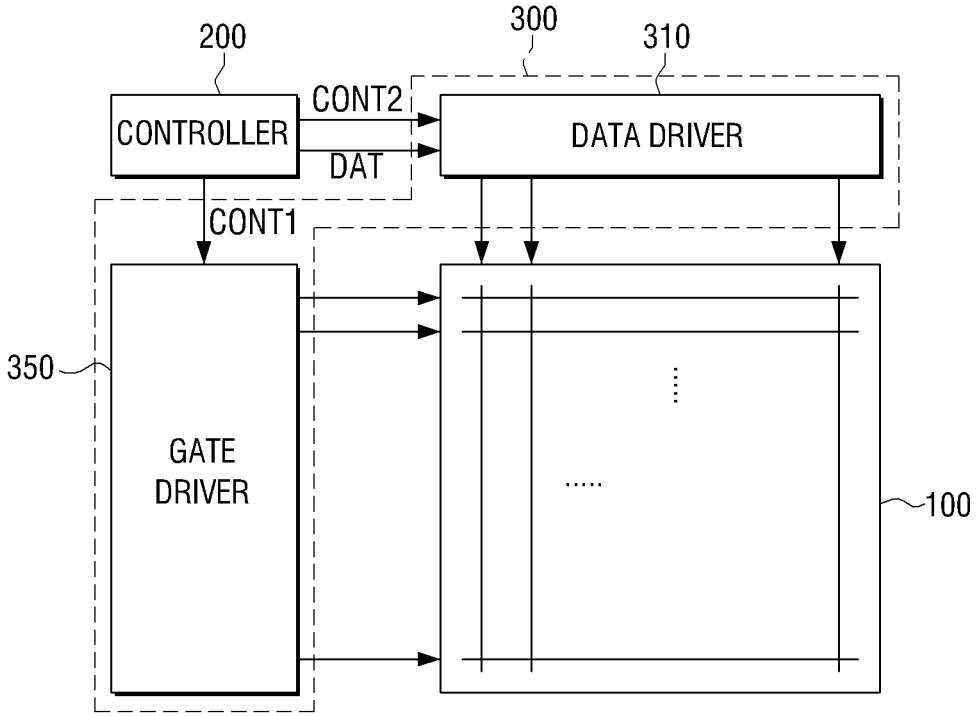
FIG. 1 is a block diagram of an LCD apparatus to which exemplary embodiments may be applicable.

Certain exemplary embodiments will now be described in greater detail with reference to the accompanying drawings.

In the following description, the same drawing reference numerals are used for the same elements, even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail.

FIG. 1 is a block diagram of an LCD apparatus to which the exemplary embodiments may be applicable. The LCD apparatus shown in FIG. 1 may receive gradation data of an image frame and mask the received gradation data with gray data, so that the masked gradation data may be displayed on a screen.

In FIG. 1, the LCD apparatus includes a panel unit 100, a controller 200 and a driving unit 300.

The panel unit 100 includes a plurality of gate lines, a plurality of data lines, and a plurality of sub-pixels which are disposed on an area where the plurality of gate lines and the plurality of data lines intersect with each other. Herein, sub-pixels refer to elements forming a single pixel, and more specifically, are classified into red (R) sub-pixels, green (G) sub-pixels and blue (B) sub-pixels. In other words, a pixel may include R sub-pixels, G sub-pixels and B sub-pixels.

Additionally, data lines receive a data voltage from a data driver that will be described below, and apply the received data voltage to each of the plurality of sub-pixels. Herein, the data voltage is obtained by conversion of gradation data into voltages, and the gradation data refers to data which defines shades of gray from black to white by adjusting transmittance of liquid crystals.

Gate lines receive a gate-on voltage from a gate driver that will be described below, and apply the received gate-on voltage to each of the plurality of sub-pixels.

The plurality of sub-pixels are formed at the intersection areas of the plurality of gate lines for applying the gate-on voltage and the plurality of data lines for applying the data voltage corresponding to the gradation data. The sub-pixels are now described in detail with reference to FIG. 2.

Figure 2:
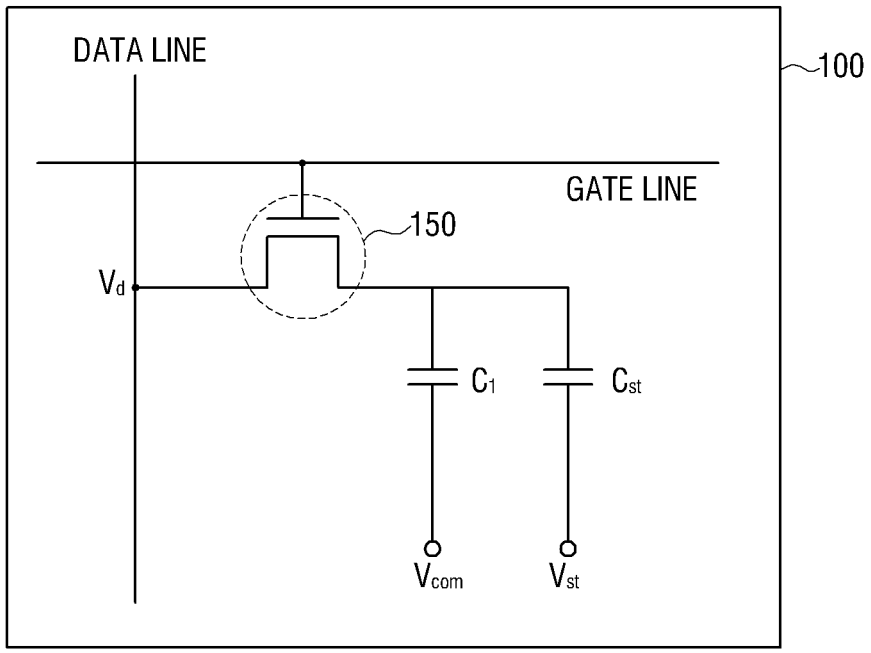
FIG. 2 is a view illustrating an example of one of a plurality of sub-pixels provided in a panel unit according to an exemplary embodiment.

FIG. 2 exemplarily illustrates one of the plurality of sub-pixels in the panel unit 100.

The sub-pixel shown in FIG. 2 includes a thin film transistor (TFT) 150, a liquid crystal capacitor Cl and a storage capacitor Cst. A source electrode and a gate electrode of the TFT 150 are coupled to a data line and a gate line, respectively, and the liquid crystal capacitor Cl and storage capacitor Cst are coupled to a drain electrode of the TFT 150.

If the gate-on voltage is applied to the gate line of the TFT 150 to turn on the TFT 150, the data voltage Vd supplied to the data line of the TFT 150 is applied to a pixel electrode (not shown) through the TFT 150. Subsequently, an electric field corresponding to a difference between a pixel voltage and a common voltage Vcom is applied to a liquid crystal, so that light with transmittance corresponding to the intensity of the electric field may be transmitted.

The panel unit 100 allows the transmittance of light passing through the liquid crystal of each sub-pixel to be controlled using the gate-on voltage applied to the gate line and the data voltage applied to the data line, so as to display a desired image.

Referring back to FIG. 1, the controller 200 receives an image signal from an external source (not shown), and performs data processing and image processing on the image signal. In more detail, the controller 200 receives RGB data signals, a data enable signal indicating a time of a frame, a synchronizing signal and a clock signal from the external source, and performs data processing, such as timing redistribution, using the received signals.

Additionally, the controller 200 processes an image so that gradation data for each of the received RGB data signals is masked with gray data. Accordingly, stress on liquid crystals may be reduced, and thus it is possible to prevent a residual image from appearing on a screen. In this situation, the received RGB data signals may be individually masked with the gray data. This masking process will be described in more detail below.

In order to drive the panel unit 100, the controller 200 transfers control signal CONT1 to a gate driver 350 of the driving unit 300, and transfers control signal CONT2 and gradation data DAT of an image frame to a data driver 310 of the driving unit 300. More specifically, the controller 200 transmits gradation data, which is obtained by individually masking the RGB data signals with the gray data, to the data driver 310.

The driving unit 300 drives the panel unit 100 using the gradation data output from the controller 200. The driving unit 300 includes the data driver 310 and the gate driver 350, as shown in dashed lines in FIG. 1.

The data driver 310 converts the gradation data output from the controller 200 into a data voltage, and applies the data voltage to each of the data lines.

The gate driver 350 sequentially applies gate-on voltages to the gate lines, so as to turn on the TFT 150 having the gate electrode which is coupled to the gate line to which the gate-on voltage is applied.

As described above, in the LCD, the gradation data may be used to reduce stress on liquid crystals, thereby preventing a residual image from appearing on the screen.

Figure 3:
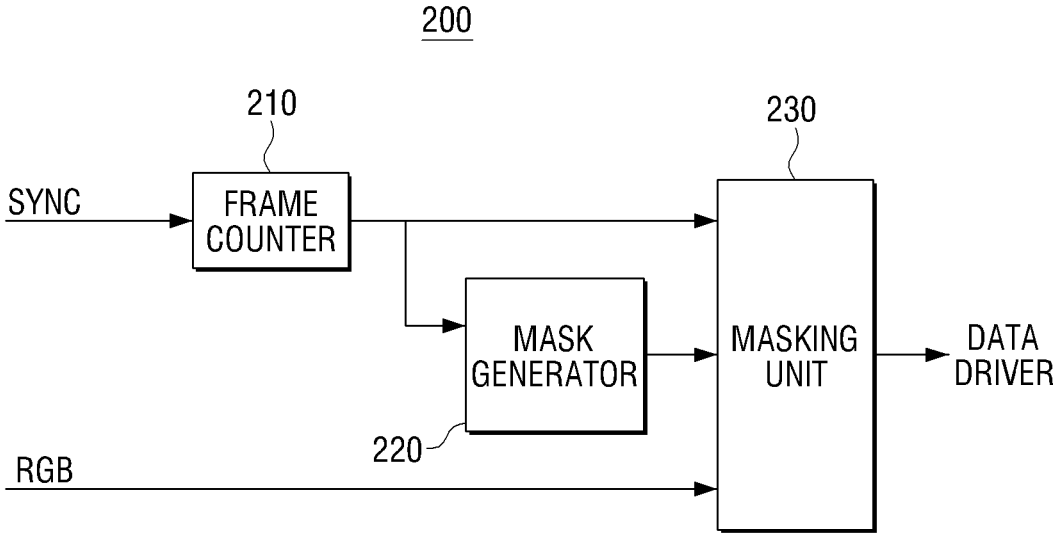
FIG. 3 is a detailed block diagram of a controller according to an exemplary embodiment.

FIG. 3 is a detailed block diagram of the controller 200. The controller 200 of FIG. 3 includes a frame counter 210, a mask generator 220 and a masking unit 230.

The frame counter 210 receives synchronizing signal SYNC, and counts the received synchronizing signal SYNC, to recognize frame period information regarding the frame period (namely, the number of frames). The frame counter 210 transfers the frame period information to the mask generator 220 and the masking unit 230.

The mask generator 220 generates masks for each frame based on the frame period information output from the frame counter 210. The generated masks may be used to change original gradation data of an image frame that is supposed to be output to gradation data masked by gray data.

The mask generated by the mask generator 220 enables gray data to be inserted into the sub-pixels according to a regular pattern. In other words, the mask generator 220 determines a pattern to insert gray data into the sub-pixels in the panel unit 100.

Patterns and masks will be described in detail with reference to FIGS. 4A to 7 below.

The mask generator 220 transfers the generated masks to the masking unit 230.

The masking unit 230 receives the masks from the mask generator 220, and masks original gradation data for RGB data of an image frame that is supposed to be output with the received masks, so that the original gradation data may be corrected by gray data. The masking unit 230 transfers the corrected gradation data to the data driver 310.

Therefore, the LCD according to the exemplary embodiment may insert the gray data into the sub-pixels using the mask according to the regular pattern, rather than outputting the RGB data without any change. Therefore, it is possible to reduce stress on liquid crystals so as to prevent a residual image from appearing on the screen. Accordingly, a user can view an image without any disturbance from a residual image.

Hereinafter, a description is made of the reason why a gray data insertion pattern is determined. To eliminate direct current offset components and prevent degradation in liquid crystal display performance, the LCD according to the exemplary embodiment may be driven in an inversion scheme in which polarity inversion occurs between liquid crystal cells in every frame period, every row or every pixel. The inversion scheme may allow the polarity of voltages supplied to liquid crystal cells to be inverted, as shown in FIGS. 4A, 4B and 4C.

Figure 4A:
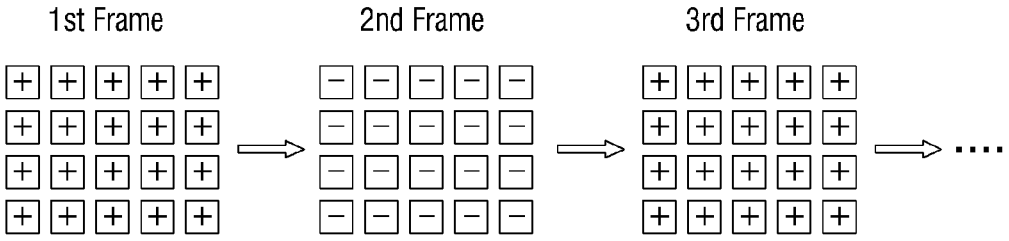
FIGS. 4A, 4B and 4C are views explaining an inversion scheme to drive an LCD.
Figure 4B:
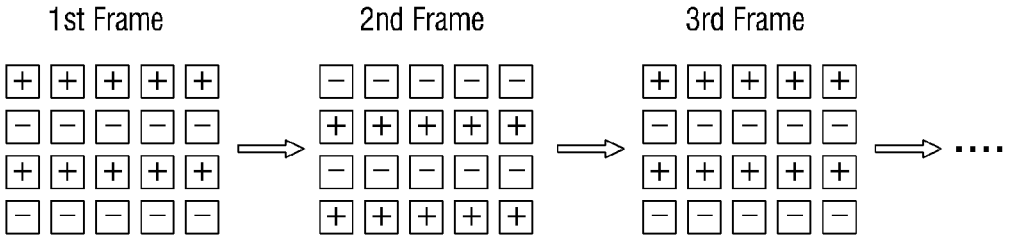
Figure 4C:
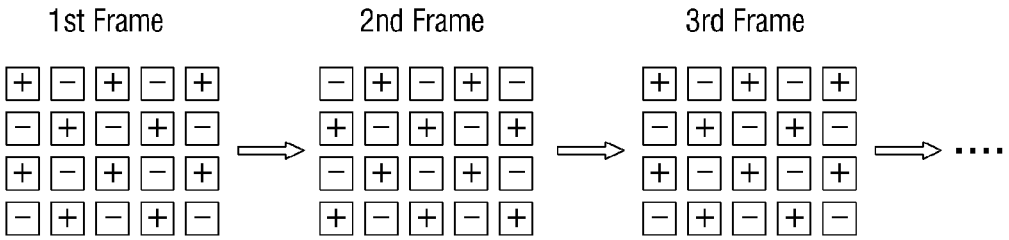

FIGS. 4A, 4B and 4C are views explaining the inversion scheme to driving the LCD.

The LCD may apply data voltages and gate voltages to pixels to form an electric field on liquid crystals. Additionally, the LCD may regulate the intensity of the electric field and adjust the transmittance of light passing through the liquid crystals, so as to obtain a desired image. Furthermore, the LCD may prevent degradation in liquid crystal display performance caused by applying voltages with the unidirectional polarity to liquid crystal layers for a long period of time. To achieve this, the LCD may invert the polarity of data voltages against gate voltages in every frame period, as shown in FIGS. 4A, 4B and 4C.

FIG. 4A exemplarily illustrates liquid crystal cells driven in the inversion scheme in which the polarity of data voltages with respect to gate voltages is inverted in every frame period, FIG. 4B exemplarily illustrates liquid crystal cells driven in the inversion scheme in which the polarity of data voltages is reversed in every frame period so that the polarity of one horizontal row of pixels is opposite to the polarity of neighboring row of pixels. Additionally, FIG. 4C exemplarily illustrates liquid crystal cells driven in the inversion scheme in which the polarity of data voltages is reversed in every frame period so that the polarity of a pixel is opposite to the polarity of neighboring pixels in horizontal and vertical directions.

Therefore, the LCD according to the exemplary embodiment may be driven in the inversion scheme as described above, so as to prevent degradation in image quality.

However, if one of voltages having opposite polarities is dominantly supplied for a long period of time, or if two polarities are alternately generated, stress may continue to be applied to liquid crystals so that a residual image may appear on the screen. Such residual image phenomenon is called "direct current (DC) image sticking" because it occurs as each liquid crystal cell is repeatedly charged with voltages having the same polarity.

To prevent DC image sticking, the LCD according to the exemplary embodiment may optionally generate gray data instead of gradation data corresponding to the RGB data that needs to be displayed on the screen, and may insert the generated gray data into the sub-pixels according to the regular pattern for each sub-pixel. In more detail, the LCD according to the exemplary embodiment may insert the gray data into sub-pixels according to the regular pattern based on the polarity of liquid crystals and the frame period, so it is possible to avoid degradation in image quality and prevent one of the voltages having opposite polarities from being dominantly supplied for a long period of time, thereby reducing stress on the liquid crystals.

Hereinafter, a pattern in which gray data is inserted into sub-pixels is described with reference to FIGS. 5 and 6.

Figure 5:
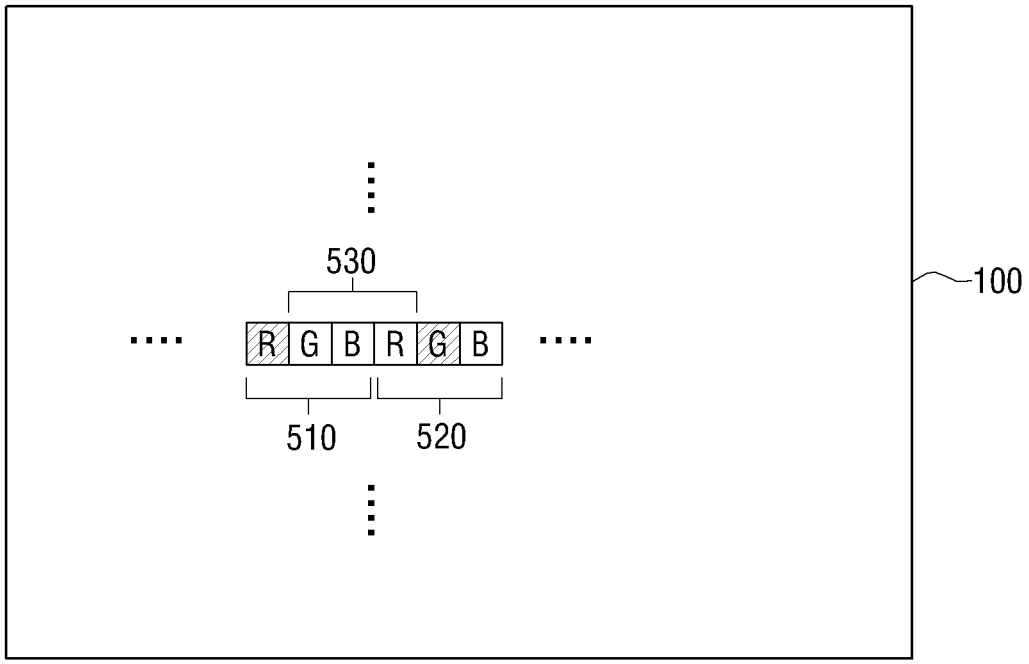
FIG. 5 is a view illustrating a pattern in which gray data is spatially inserted for each sub-pixel while maintaining a single pixel in a single frame period.

FIG. 5 exemplarily illustrates a pattern in which gray data is spatially inserted into sub-pixels while maintaining a single pixel in a single frame period. The panel unit 100 shown in FIG. 5 includes a first pixel 510 and a second pixel 520, which each contain an R sub-pixel, a G sub-pixel and a B sub-pixel.

Gray data is inserted into the R sub-pixel of the first pixel 510, and gray data is inserted into the G sub-pixel of the second pixel 520. Accordingly, sub-pixels of the two neighboring pixels 510 and 520 into which gray data is not inserted may form a single pixel. In more detail, the G sub-pixel and B sub-pixel of the first pixel 510 and the R sub-pixel of the second pixel 520 which do not have the gray data may form a third pixel 530.

As described above, the gray data is spatially inserted into sub-pixels, and the sub-pixels, into which the gray data is not inserted, form a single pixel according to the pattern shown in FIG. 5, and therefore it is possible to achieve excellent effects in image reconstruction based on the original RGB data, compared to a situation in which gray data is inserted in an irregular pattern.

Figure 6:
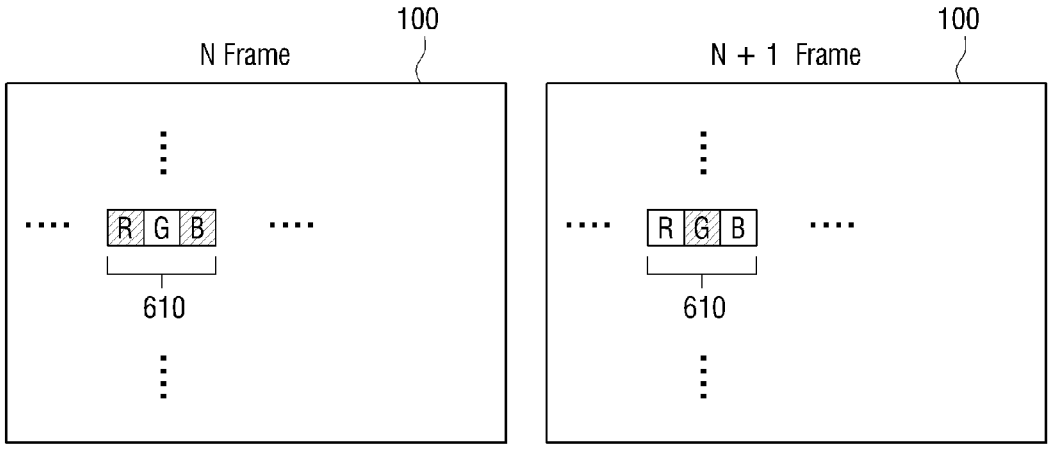
FIG. 6 is a view illustrating a pattern in which gray data is temporally inserted for each sub-pixel while maintaining a single pixel in a plurality of frame periods.

FIG. 6 exemplarily illustrates a pattern in which gray data is temporally inserted into sub-pixels while maintaining a single pixel in a plurality of frame periods. In the pattern of FIG. 6, gray data is inserted into each sub-pixel of the same pixel 610 during two frame periods, namely an Nth frame period and (N+1)th frame period which is subsequent to the Nth frame period. The pixel 610 contains an R sub-pixel, a G sub-pixel and a B sub-pixel.

During the Nth frame period, gray data is inserted into the R sub-pixel and B sub-pixel of the pixel 610. During the (N+1)th frame period, gray data is inserted into the G sub-pixel of the pixel 610. In other words, the G sub-pixel of the pixel 610 in the Nth frame period and the R sub-pixel and B sub-pixel of the pixel 610 in the (N+1)th frame period do not have any gray data, and accordingly these sub-pixels into which the gray data is not inserted may form a single pixel.

As described above, the gray data is temporally inserted into sub-pixels and the sub-pixels, into which the gray data is not inserted, form a single pixel according to the pattern shown in FIG. 6, and therefore it is possible to achieve excellent results in image reconstruction based on the original RGB data, compared to a situation in which gray data is inserted in an irregular pattern.

The patterns described with reference to FIGS. 5 and 6 are merely exemplary for convenience of description, and accordingly exemplary embodiments are also applicable to patterns other than the patterns shown in FIGS. 5 and 6. Additionally, gray data may be inserted in a pattern obtained by combining the pattern of FIG. 5 and the pattern of FIG. 6.

Furthermore, a pattern in which gray data is inserted into each of sub-pixels contained in each pixel at least once during a preset frame period may be used. In this situation, each pattern includes a plurality of sub-patterns, which may be changed in every preset frame period.

To insert gray data into sub-pixels as described above, the mask generator 220 generates masks for each frame based on the frame period information output from the frame counter 210.

Figure 7:
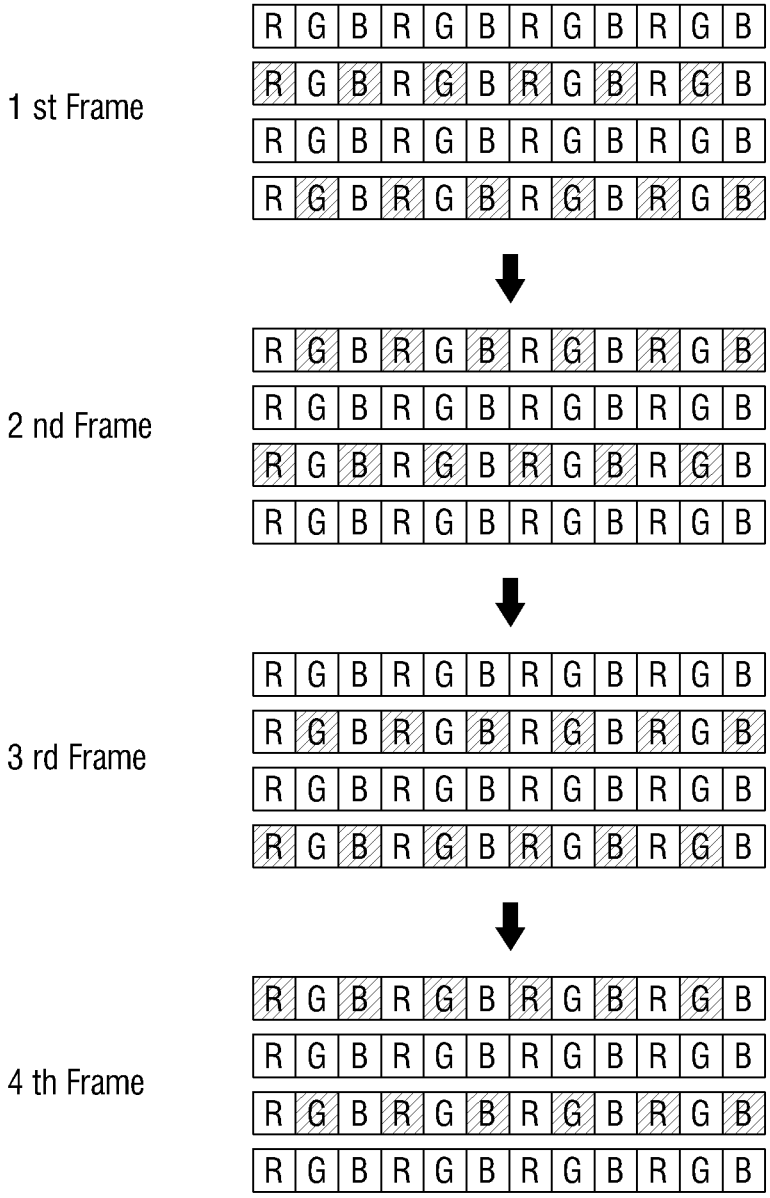
FIG. 7 is a view illustrating a mask generated by a mask generator during four frame periods.

FIG. 7 is a view illustrating a mask generated by the mask generator 220 during four frame periods.

In FIG. 7, in the first frame period, gray data is alternately inserted into sub-pixels in even-numbered rows, not in odd-numbered rows. In more detail, the gray data is inserted into sub-pixels in odd-numbered columns in the second row and sub-pixels in even-numbered columns in the fourth row.

In the second frame period, gray data is alternately inserted into sub-pixels in odd-numbered rows, not in even-numbered rows. In more detail, the gray data is inserted into sub-pixels in even-numbered columns in the first row and sub-pixels in odd-numbered columns in the third row.

In the third frame period, gray data is alternately inserted into sub-pixels in even-numbered rows, not in odd-numbered rows. In more detail, the gray data is inserted into sub-pixels in even-numbered columns in the second row and sub-pixels in odd-numbered columns in the fourth row.

In the fourth frame period, gray data is alternately inserted into sub-pixels in odd-numbered rows, not in even-numbered rows. In more detail, the gray data is inserted into sub-pixels in odd-numbered columns in the first row and sub-pixels in even-numbered columns in the third row.

As described above, the mask generator 220 generates masks for each frame to cause gray data to be inserted into sub-pixels, and the masking unit 230 masks the input RGB data with the generated masks.

Additionally, in the fifth frame period, a mask is generated in the same manner as the second frame period. In other words, in the fifth frame period, gray data is alternately inserted into sub-pixels in odd-numbered rows, not in even-numbered rows, and more specifically, the gray data is inserted into sub-pixels in even-numbered columns in the first row and sub-pixels in odd-numbered columns in the third row.

In the sixth frame period, a mask is generated in the same manner as the third frame period. In the seventh frame period, a mask is generated in the same manner as the fourth frame period. In the eighth frame period, a mask is generated in the same manner as the first frame period.

The gray data insertion pattern described above is partially identical to the order of a sub-pattern in which the gray data is inserted from the first frame to the fourth frame. In a changed sub-pattern, gray data is inserted first into a sub-pixel into which gray data has been inserted secondarily in the original sub-pattern. Additionally, gray data is inserted lastly into a sub-pixel into which gray data has been inserted first in the original sub-pattern.

Herein, the concept of "sub-pattern" is used in determining a point of time at which gray data is inserted into each sub-pixel, in order to prevent occurrence of DC image sticking, that is, to prevent stress from continuing to be applied to liquid crystals caused by dominantly supplying the one of voltages having opposite polarities for a long period of time or by allowing two polarities to be alternately generated. Accordingly, the main pattern and sub-patterns may be formed taking into consideration the polarity of liquid crystals.

Figure 8:
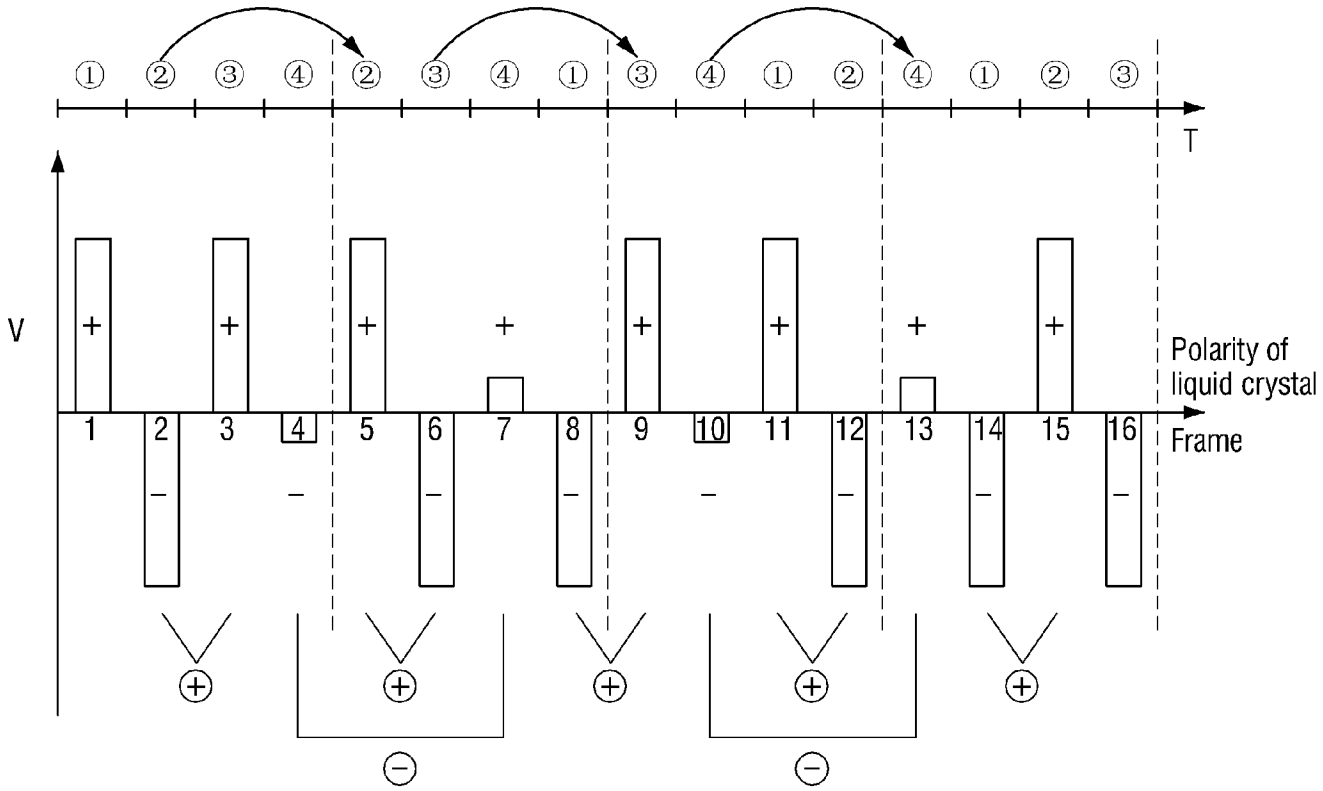
FIG. 8 is a view explaining a polarity of a liquid crystal of a pixel.

This is described with reference to FIG. 8. FIG. 8 is a view explaining the polarity of liquid crystals of a pixel. For convenience of description, it is assumed in FIG. 8 that gray data is inserted into sub-pixels as shown in FIG. 7.

The LCD according to the exemplary embodiment is driven in the inversion scheme described above, and thus the polarity of liquid crystals on each of pixels in each frame may be varied in the order of +→−→+→−→+→−→+→−→+→−→+→−→+→−→+→− in sixteen successive frame periods. Accordingly, the polarity of liquid crystals on sub-pixels of each pixel may also be varied in the same manner as that described above. Therefore, a DC component is set to be 0.

In this situation, a positive voltage becomes dominant compared to a negative voltage, by the sum of the positive voltage in the first frame period and the negative voltage in the second frame period, and a positive voltage becomes dominant compared to a negative voltage, by the sum of the positive voltage in the third frame period and the negative voltage in the fourth frame period. Additionally, a positive voltage becomes dominant compared to a negative voltage, by the sum of the positive voltage in the fifth frame period and the negative voltage in the sixth frame period, and a positive voltage becomes dominant compared to a negative voltage, by the sum of the positive voltage in the seventh frame period and the negative voltage in the eighth frame period.

Moreover, a positive voltage becomes dominant compared to a negative voltage, by the sum of the positive voltage in the ninth frame period and the negative voltage in the tenth frame period, and a positive voltage becomes dominant compared to a negative voltage, by the sum of the positive voltage in the eleventh frame period and the negative voltage in the twelfth frame period. Additionally, a positive voltage becomes dominant compared to a negative voltage, by the sum of the positive voltage in the thirteenth frame period and the negative voltage in the fourteenth frame period, and a positive voltage becomes dominant compared to a negative voltage, by the sum of the positive voltage in the fifteenth frame period and the negative voltage in the sixteenth frame period.

While the positive voltages are dominant compared to the negative voltages during the sixteen successive frame periods as described above, there is no limitation thereto. Accordingly, the positive voltages may continue to be dominant during frame periods following the sixteen frame periods.

For example, if a dominant positive voltage is supplied for a long period of time, as described above, stress may be continuously applied to liquid crystals, and thus "DC image sticking" may occur.

To reduce the stress applied to liquid crystals, the LCD according to the exemplary embodiment may intermittently insert gray data into each sub-pixel. Accordingly, a negative voltage may become dominant compared to a positive voltage by the sum of voltages in frame periods during which the gray data is inserted, and thus, the dominance of the positive voltage may be reduced by the sum of voltages in frame periods during which the gray data is not inserted. In addition, it is possible to prevent the positive voltage from being dominantly supplied for a long period of time.

Referring to FIG. 8, the gray data is inserted into sub-pixels in the fourth frame period, the seventh frame period, the tenth frame period and the thirteenth frame period, and thus the dominance of the positive voltage applied to liquid crystals may be entirely reduced.

In more detail, the sum of voltages in the fourth frame period and seventh frame period during which gray data is inserted enables the negative voltage to become dominant, and the sum of voltages in the tenth frame period and thirteenth frame period during which gray data is inserted enables the negative voltage to become dominant. Accordingly, it is possible to reduce the dominance of the positive voltage during the sixteen successive frame periods, and to prevent the positive voltage from being dominantly supplied for a long period of time.

Therefore, it is possible to reduce stress on liquid crystals so as to prevent a residual image from appearing on the screen.

Figure 9:
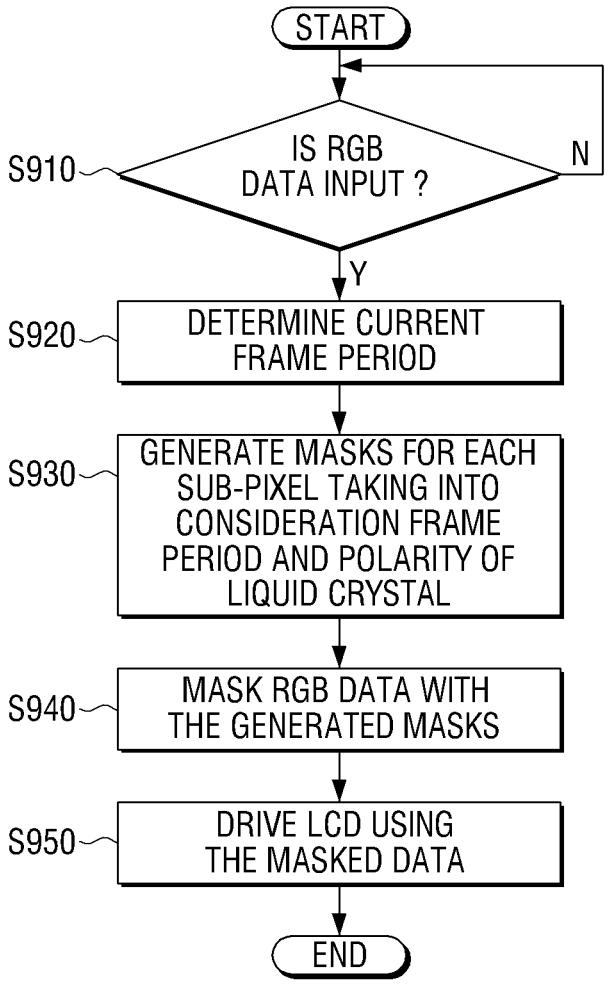
FIG. 9 is a flowchart explaining a method for driving an LCD according to an exemplary embodiment.

FIG. 9 is a flowchart explaining a method for driving the LCD according to the exemplary embodiment.

First, the LCD receives RGB data for each frame (S910). The LCD determines a current frame period using the RGB data received for each frame (S920), and generates a mask to insert gray data into each sub-pixel, taking into consideration the current frame period and the polarity of liquid crystals of a pixel (S930).

Subsequently, the LCD masks the RGB data with the generated mask (S940), and is driven using the masked RGB data (S950).

As described above, the random seed determination method and the method for driving the LCD apparatus may reduce stress on liquid crystals, thereby preventing a residual image from appearing on the screen.

Additionally, there is no need to equally apply the above-described gray data to all of the sub-pixels in the panel unit 100. In other words, the gray data may be applied to only sub-pixels corresponding to areas where there is almost no change in the input RGB data.

Figure 10:
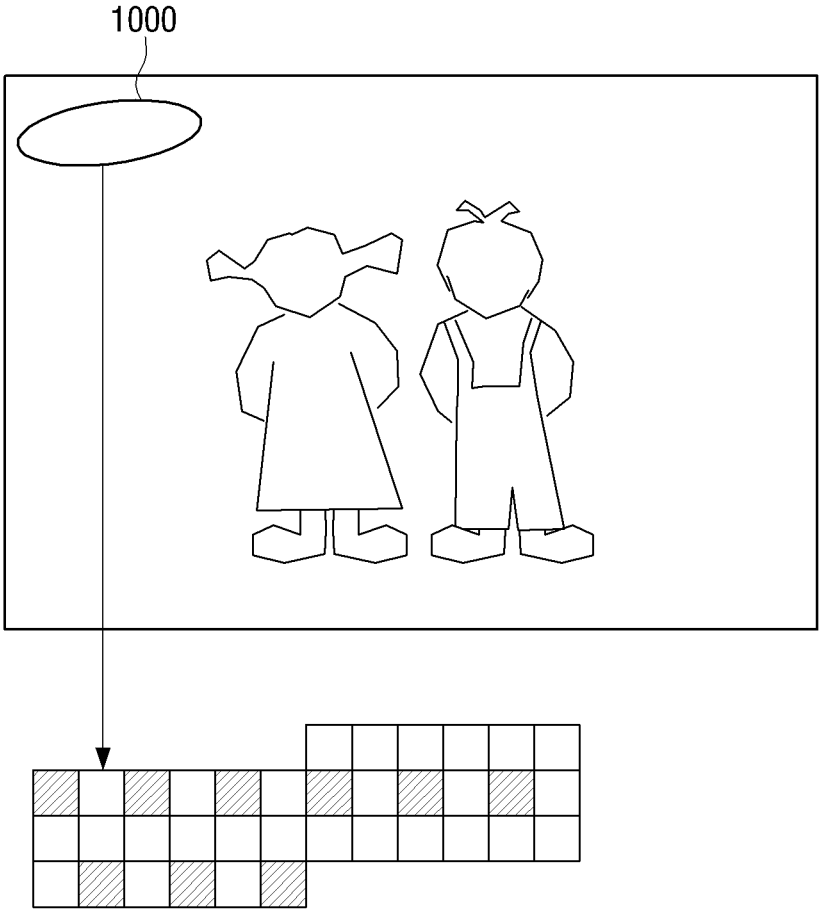
FIG. 10 illustrates a situation in which gray data is applied to only a part of a screen according to a main pattern and sub-patterns.

FIG. 10 illustrates a situation in which gray data is applied to only a part of a screen according to a main pattern and sub-patterns.

Gray data may be applied to a predetermined area of the screen, when the same image, for example a logo or trademark in advertising, continues to be displayed on the predetermined area only. For example, if the same trademark 1000 continues to be displayed on an upper left end of the screen, but image portions other than the same trademark 1000 continue to be changed and displayed, as shown in FIG. 10, gray data may be inserted into only pixels corresponding to the same trademark 1000, not pixels corresponding to the image portions other than the same trademark 1000.

Therefore, it is possible to more efficiently reduce stress on liquid crystals and prevent a residual image from appearing on the screen.

Additionally, if the residual image phenomenon is prevented, a user may view an image without any disturbance, and panel replacement costs may also be prevented from being incurred.

The foregoing exemplary embodiments and advantages are merely exemplary and are not to be construed as limiting the present invention. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A liquid crystal display apparatus which prevents a residual image from appearing on a screen, the liquid crystal display apparatus comprising:

a panel unit which comprises at least one pixel comprising a plurality of sub-pixels; and a controller configured to insert mask gray data into at least one sub-pixel of the plurality of sub-pixels, based on a frame period and a polarity of a liquid crystal of the at least one pixel, wherein the controller is configured to generate masks for each frame to mask gradation data with gray data.

2. The liquid crystal display apparatus of claim 1, wherein the grey data is inserted into the at least one sub-pixel while maintaining a single pixel in a single frame period.

3. The liquid crystal display apparatus as claimed in claim 1, wherein the data is masked by, during at least one frame period, the controller inserts the gray data so that a sub-pixel, which is contained in a first pixel and into which the gray data is not inserted, and another sub-pixel, which is contained in a second pixel neighboring the first pixel and into which the gray data is not inserted, form at least one pixel.

4. The liquid crystal display apparatus as claimed in claim 1, wherein the controller inserts the gray data so that a sub-pixel of at least one pixel into which the gray data is not inserted in a first frame, and a sub-pixel of at least one pixel into which the gray data is not inserted in a second frame subsequent to the first frame, form at least one pixel.

5. The liquid crystal display apparatus as claimed in claim 1, wherein the controller inserts the gray data according to a pattern in which the gray data is inserted at least once into a plurality of sub-pixels of each pixel during a preset frame period.

6. The liquid crystal display apparatus as claimed in claim 5, wherein the pattern comprises a plurality of sub-patterns, and the controller causes the plurality of sub-patterns to be changed in every preset frame period.

7. The liquid crystal display apparatus as claimed in claim 6, wherein a changed sub-pattern is partially identical to an order of the original sub-pattern, and in the changed sub-pattern, the controller inserts the gray data first into a sub-pixel, into which gray data has been inserted secondarily in the original sub-pattern, and inserts the gray data lastly into a sub-pixel, into which gray data has been inserted first in the original sub-pattern.

8. The liquid crystal display apparatus as claimed in claim 1, wherein the controller determines a frame in which the gray data is to be inserted again so that a number of times when liquid crystals of a pixel comprising a predetermined sub-pixel have a positive polarity equals a number of times when the liquid crystals have a negative polarity between a frame in which the gray data is inserted into the predetermined sub-pixel and the frame in which the gray data is to be inserted again.

9. The liquid crystal display apparatus as claimed in claim 8, wherein a period between the frame into which the gray data is inserted and the frame into which the gray data is to be inserted again is an odd-numbered frame period.

10. The liquid crystal display apparatus as claimed in claim 1, further comprising:

an input unit which receives an input of red, green, blue (RGB) data, wherein the controller generates a gray data mask based on information regarding sub-pixels of a current frame into which the gray data is to be inserted among the plurality of sub-pixels in the panel unit, masks the input RGB data with the gray data mask, and inserts the masked RGB data.

11. The liquid crystal display apparatus as claimed in claim 10, further comprising:

a driving unit which generates a gray data voltage or a normal data voltage and applies the generated gray data voltage or normal data voltage to the plurality of sub-pixels, wherein the controller controls the driving unit based on the masked RGB data to apply the gray data voltage or the normal data voltage to each of the plurality of sub-pixels, so that the gray data is inserted.

12. The liquid crystal display apparatus as claimed in claim 1, wherein the controller inserts the gray data into at least one sub-pixel of the plurality of sub-pixels in a predetermined local area of the panel unit.

13. The liquid crystal display apparatus as claimed in claim 12, wherein the predetermined local area of the panel unit is an area on which a same image is displayed above a predetermined time.

14. A liquid crystal display apparatus which prevents a residual image from appearing on a screen, the liquid crystal display apparatus comprising:

a panel unit which comprises at least one pixel comprising a plurality of sub-pixels; and a controller configured to insert mask gray data into the plurality of sub-pixels of the at least one pixel based on a polarity of a liquid crystal of the at least one pixel, wherein the polarity of the liquid crystal is reversed every frame period, wherein the controller is configured to generate masks for each frame to mask gradation data with grey data.

15. A liquid crystal display apparatus which prevents a residual image from appearing on a screen, the liquid crystal display apparatus comprising:

a gate driver which transfers a gate-on voltage to at least one pixel comprising a plurality of sub-pixels; and a data driver which transfers a gray data voltage to the plurality of sub-pixels based on a frame period and a polarity of a liquid crystal of the at least one pixel, wherein the polarity of the liquid crystal is reversed every frame period: and a controller configured to insert mask gray data into at least one sub-pixel of the plurality of sub-pixels, based on a frame period and a polarity of a liquid crystal of the at least one pixel, wherein the controller is configured to generate masks for each frame to mask gradation data with grey data.

16. A method of driving a liquid crystal display apparatus which prevents a residual image from appearing on a screen, the method comprising:

inserting mask gray data into at least one sub-pixel of the plurality of sub-pixels, based on a frame period and a polarity of a liquid crystal of the at least one pixel, and generating masks for each frame to mask gradation data with grey data;

applying a gray data voltage to a part of a plurality of sub-pixels contained in at least one pixel and applying a normal data voltage to a remaining part of the plurality of sub-pixels, based on a frame period and a polarity of a liquid crystal of the at least one pixel, and displaying an image based on the gray data voltage and the normal data voltage.

17. The method as claimed in claim 16, further comprising:

receiving an input of red, green, blue (RGB) data;

generating a gray data mask based on information regarding sub-pixels of a current frame into which the gray data needs to be inserted among a plurality of sub-pixels in a panel of the LCD apparatus; and masking the input RGB data with the gray data mask, wherein the applying comprises applying the gray data voltage or the normal data voltage to the sub-pixels based on the masked RGB data.

18. The method as claimed in claim 16, wherein the applying comprises applying the normal data voltage during at least one frame period so that a sub-pixel, which is contained in a first pixel and into which the gray data is not inserted, and another sub-pixel, which is contained in a second pixel neighboring the first pixel and into which the gray data is not inserted, form at least one pixel.

19. The method as claimed in claim 16, wherein the applying comprises applying the normal data voltage so that a sub-pixel of at least one pixel into which the gray data is not inserted in a first frame, and a sub-pixel of at least one pixel into which the gray data is not inserted in a second frame subsequent to the first frame, form at least one pixel.

20. The method as claimed in claim 16, wherein the applying comprises applying the gray data voltage according to a pattern in which the gray data is inserted at least once into a plurality of sub-pixels of each pixel during a preset frame period.

21. The method as claimed in claim 20, wherein the pattern comprises a plurality of sub-patterns, the applying comprises applying the gray data voltage and the normal data voltage so that the plurality of sub-patterns are changed in every preset frame period.

22. The method as claimed in claim 21, wherein a changed sub-pattern is partially identical to an order of the original sub-pattern, and the applying further comprises applying the gray data voltage in the changed sub-pattern so that the gray data is inserted first into a sub-pixel, into which gray data has been inserted secondarily in the original sub-pattern, and the gray data is inserted lastly into a sub-pixel, into which gray data has been inserted first in the original sub-pattern.

23. The method as claimed in claim 16, wherein the applying further comprises determining a frame in which the gray data is to be inserted again so that a number of times when liquid crystals of a pixel comprising a predetermined sub-pixel have a positive polarity equals to a number of times when the liquid crystals have a negative polarity between a frame in which the gray data is inserted into the predetermined sub-pixel and the frame in which the gray data is to be inserted again, and applying the gray data voltage to the determined frame.

24. The method as claimed in claim 23, wherein a period between the frame into which the gray data is inserted and the frame into which the gray data is to be inserted again is an odd-numbered frame period.

25. A liquid crystal display apparatus which prevents a residual image from appearing on a screen, the liquid crystal display apparatus comprising:

a panel unit which comprises at least one pixel comprising a plurality of sub-pixels; and a controller configured to insert mask gray data into at least one sub-pixel of the plurality of sub-pixels, based on a frame period and a polarity of a liquid crystal of the at least one pixel, wherein the polarity of the liquid crystal is reversed every frame period, wherein the controller is configured to generate masks for each frame to mask gradation data with grey data.

26. A method of driving a liquid crystal display apparatus which prevents a residual image from appearing on a screen, the method comprising:

inserting mask gray data into at least one sub-pixel of the plurality of sub-pixels, based on a frame period and a polarity of a liquid crystal of the at least one pixel, and generating masks for each frame to mask gradation data with grey data;

applying a gray data voltage to a part of a plurality of sub-pixels contained in at least one pixel and applying a normal data voltage to a remaining part of the plurality of sub-pixels, based on a frame period and a polarity of a liquid crystal of the at least one pixel, wherein the polarity of the liquid crystal is reversed every frame period; and displaying an image based on the gray data voltage and the normal data voltage.

* * * * *